US009183799B2

(12) United States Patent
Hotelling et al.

(10) Patent No.: US 9,183,799 B2
(45) Date of Patent: Nov. 10, 2015

(54) ADDITIONAL APPLICATION OF VOLTAGE DURING A WRITE SEQUENCE

(75) Inventors: Steven Porter Hotelling, Los Gatos, CA (US); Marduke Yousefpor, San Jose, CA (US); Hopil Bae, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 431 days.

(21) Appl. No.: 13/143,184

(22) PCT Filed: May 24, 2011

(86) PCT No.: PCT/US2011/037803

§ 371 (c)(1),
(2), (4) Date: Jul. 1, 2011

(87) PCT Pub. No.: WO2012/161699

PCT Pub. Date: Nov. 29, 2012

(65) Prior Publication Data

US 2012/0299971 A1 Nov. 29, 2012

(51) Int. Cl.
*G09G 3/36* (2006.01)
*G09G 3/32* (2006.01)

(52) U.S. Cl.
CPC ..... *G09G 3/3614* (2013.01); *G09G 3/3659* (2013.01); *G09G 3/3688* (2013.01); *G09G 3/3233* (2013.01); *G09G 3/3607* (2013.01); *G09G 3/3648* (2013.01); *G09G 2310/027* (2013.01); *G09G 2310/0297* (2013.01); *G09G 2320/0209* (2013.01); *G09G 2320/0233* (2013.01); *G09G 2320/0252* (2013.01)

(58) Field of Classification Search
CPC combination set(s) only.
See application file for complete search history.

(56) References Cited

U.S. PATENT DOCUMENTS

| | | | |
|---|---|---|---|
| 5,483,261 | A | 1/1996 | Yasutake |
| 5,488,204 | A | 1/1996 | Mead et al. |
| 5,825,352 | A | 10/1998 | Bisset et al. |
| 5,835,079 | A | 11/1998 | Shieh |
| 5,880,411 | A | 3/1999 | Gillespie et al. |
| 6,188,391 | B1 | 2/2001 | Seely et al. |

(Continued)

FOREIGN PATENT DOCUMENTS

| | | | |
|---|---|---|---|
| EP | 1 411 492 | A1 | 4/2004 |
| JP | 2000-163031 | A | 6/2000 |

(Continued)

OTHER PUBLICATIONS

Lee, S.K. et al. (Apr. 1985). "A Multi-Touch Three Dimensional Touch-Sensitive Tablet," *Proceedings of CHI: ACM Conference on Human Factors in Computing Systems*, pp. 21-25.

(Continued)

*Primary Examiner* — Linh N Hoffner
(74) *Attorney, Agent, or Firm* — Morrison & Foerster LLP

(57) ABSTRACT

With respect to liquid crystal display inversion schemes, a large change in voltage on a data line can affect the voltages on adjacent data lines due to capacitive coupling between data lines. The resulting change in voltage on these adjacent data lines can give rise to visual artifacts in the data lines' corresponding sub-pixels. Various embodiments of the present disclosure serve to prevent or reduce these visual artifacts by applying voltage to a data line more than once during the write sequence. Doing so can allow erroneous brightening or darkening caused by large voltage swings to be overwritten without causing additional large voltage swings on the data line.

22 Claims, 13 Drawing Sheets

(56) References Cited

U.S. PATENT DOCUMENTS

| | | | | |
|---|---|---|---|---|
| 6,310,610 | B1 | 10/2001 | Beaton et al. | |
| 6,323,846 | B1 | 11/2001 | Westerman et al. | |
| 6,690,387 | B2 | 2/2004 | Zimmerman et al. | |
| 7,015,894 | B2 | 3/2006 | Morohoshi | |
| 7,184,064 | B2 | 2/2007 | Zimmerman et al. | |
| 7,268,764 | B2 * | 9/2007 | Song et al. | 345/100 |
| 7,369,124 | B2 * | 5/2008 | Nakano et al. | 345/204 |
| 7,391,414 | B2 * | 6/2008 | Wakimoto et al. | 345/209 |
| 7,663,607 | B2 | 2/2010 | Hotelling et al. | |
| 8,269,710 | B2 * | 9/2012 | Masui | 345/98 |
| 8,479,122 | B2 | 7/2013 | Hotelling et al. | |
| 2002/0039096 | A1 * | 4/2002 | Katsutani | 345/204 |
| 2004/0246210 | A1 * | 12/2004 | Azami | 345/76 |
| 2005/0206596 | A1 * | 9/2005 | Chen et al. | 345/87 |
| 2006/0026521 | A1 | 2/2006 | Hotelling et al. | |
| 2006/0087484 | A1 | 4/2006 | Kumeta | |
| 2006/0197753 | A1 | 9/2006 | Hotelling | |
| 2007/0091050 | A1 | 4/2007 | Katayama et al. | |
| 2007/0115231 | A1 * | 5/2007 | Kumeta | 345/88 |
| 2008/0100609 | A1 * | 5/2008 | Lee et al. | 345/212 |
| 2008/0136990 | A1 | 6/2008 | Kimura | |
| 2009/0002355 | A1 * | 1/2009 | Iwatsu | 345/205 |
| 2009/0310047 | A1 * | 12/2009 | Shin | G09G 3/3659 349/37 |
| 2010/0134707 | A1 * | 6/2010 | Kim | G02F 1/133707 349/37 |
| 2010/0195004 | A1 | 8/2010 | Hotelling | |
| 2010/0320009 | A1 * | 12/2010 | Kuo et al. | 178/18.06 |
| 2012/0075281 | A1 * | 3/2012 | Moon | G09G 3/003 345/212 |

FOREIGN PATENT DOCUMENTS

| | | | |
|---|---|---|---|
| JP | 2002-342033 | A | 11/2002 |
| WO | WO-2012/161699 | A1 | 11/2012 |

OTHER PUBLICATIONS

Rubine, D.H. (Dec. 1991). "The Automatic Recognition of Gestures," CMU-CS-91-202, Submitted in Partial Fulfillment of the Requirements for the Degree of Doctor of Philosophy in Computer Science at Carnegie Mellon University, 285 pages.

Rubine, D.H. (May 1992). "Combining Gestures and Direct Manipulation," CHI ' 92, pp. 659-660.

Westerman, W. (Spring 1999). "Hand Tracking, Finger Identification, and Chordic Manipulation on a Multi-Touch Surface," A Dissertation Submitted to the Faculty of the University of Delaware in Partial Fulfillment of the Requirements for the Degree of Doctor of Philosophy in Electrical Engineering, 364 pages.

International Search Report mailed Jan. 27, 2012, for PCT Application No. PCT/US2011/037803, filed May 24, 2011, six pages.

* cited by examiner

| | | | | | |
|---|---|---|---|---|---|
| − | + | − | + | − | + |
| − | + | − | + | − | + |
| − | + | − | + | − | + |
| − | + | − | + | − | + |

FRAME 1

| | | | | | |
|---|---|---|---|---|---|
| + | − | + | − | + | − |
| + | − | + | − | + | − |
| + | − | + | − | + | − |
| + | − | + | − | + | − |

FRAME 2

*FIG. 3A*

| | | | | | |
|---|---|---|---|---|---|
| − | − | + | + | − | − |
| − | − | + | + | − | − |
| − | − | + | + | − | − |
| − | − | + | + | − | − |

FRAME 1

| | | | | | |
|---|---|---|---|---|---|
| + | + | − | − | + | + |
| + | + | − | − | + | + |
| + | + | − | − | + | + |
| + | + | − | − | + | + |

FRAME 2

*FIG. 3B*

| | | | | | |
|---|---|---|---|---|---|
| − | − | − | + | + | + |
| − | − | − | + | + | + |
| − | − | − | + | + | + |
| − | − | − | + | + | + |

FRAME 1

| | | | | | |
|---|---|---|---|---|---|
| + | + | + | − | − | − |
| + | + | + | − | − | − |
| + | + | + | − | − | − |
| + | + | + | − | − | − |

FRAME 2

*FIG. 3C*

Pixel *402* at Time T0 | Pixel *404* at Time T0

Pixel *402* at Time T1 | Pixel *404* at Time T1

Pixel *402* at Time T2 | Pixel *404* at Time T2

Pixel 602 at Time T0 | Pixel 604 at Time T0

Pixel 602 at Time T1 | Pixel 604 at Time T1

Pixel 602 at Time T2 | Pixel 604 at Time T2

| Row | Display Panel | Update Set |
|---|---|---|
| 0 | ++++++++++ | Update Set 1 |
| 1 | ---------- | Update Set 2 |
| 2 | ++++++++++ | Update Set 1 |
| 3 | ---------- | Update Set 2 |
| 4 | ++++++++++ | Update Set 1 |
| 5 | ---------- | Update Set 2 |
| 6 | ++++++++++ | Update Set 1 |
| 7 | ---------- | Update Set 2 |
| 8 | ++++++++++ | Update Set 3 |
| 9 | ---------- | Update Set 4 |
| 10 | ++++++++++ | Update Set 3 |
| 11 | ---------- | Update Set 4 |
| 12 | ++++++++++ | Update Set 3. |
| 13 | ---------- | Update Set 4 |
| 14 | ++++++++++ | Update Set 3 |
| 15 | ---------- | Update Set 4 |

*FIG. 7*

| | | | | | |
|---|---|---|---|---|---|
| + | − | + | − | + | − |
| − | + | − | + | − | + |
| + | − | + | − | + | − |
| − | + | − | + | − | + |
| + | − | + | − | + | − |
| − | + | − | + | − | + |

FRAME 1

| | | | | | |
|---|---|---|---|---|---|
| − | + | − | + | − | + |
| + | − | + | − | + | − |
| − | + | − | + | − | + |
| + | − | + | − | + | − |
| − | + | − | + | − | + |
| + | − | + | − | + | − |

FRAME 2

*FIG. 8A*

| | | | | | |
|---|---|---|---|---|---|
| + | + | − | − | + | + |
| − | − | + | + | − | − |
| + | + | − | − | + | + |
| − | − | + | + | − | − |
| + | + | − | − | + | + |
| − | − | + | + | − | − |

FRAME 1

| | | | | | |
|---|---|---|---|---|---|
| − | − | + | + | − | − |
| + | + | − | − | + | + |
| − | − | + | + | − | − |
| + | + | − | − | + | + |
| − | − | + | + | − | − |
| + | + | − | − | + | + |

FRAME 2

*FIG. 8B*

| | | | | | |
|---|---|---|---|---|---|
| + | + | + | − | − | − |
| − | − | − | + | + | + |
| + | + | + | − | − | − |
| − | − | − | + | + | + |
| + | + | + | − | − | − |
| − | − | − | + | + | + |

FRAME 1

| | | | | | |
|---|---|---|---|---|---|
| − | − | − | + | + | + |
| + | + | + | − | − | − |
| − | − | − | + | + | + |
| + | + | + | − | − | − |
| − | − | − | + | + | + |
| + | + | + | − | − | − |

FRAME 2

*FIG. 8C*

Pixel *900*
at Time T0

Pixel *900*
at Time T1

Pixel *900*
at Time T2

Pixel *900*
at Time T3

Pixel *900*
at Time T4

Pixel *1000* at Time T0 Pixel *1010* at Time T0

Pixel *1000* at Time T0 Pixel *1010* at Time T0

Pixel *1000* at Time T0 Pixel *1010* at Time T0

Pixel *1000* at Time T3 Pixel *1010* at Time T3

ADDITIONAL APPLICATION OF VOLTAGE DURING A WRITE SEQUENCE

This application is a United States National Stage Application under 35 U.S.C. §371 of International Patent Application No. PCT/US2011/037803, filed May 24, 2011, which is incorporated by reference in its entirety for all intended purposes.

FIELD OF THE DISCLOSURE

This relates generally to electrical shield systems in display screens, and more particularly, to electrical shield line systems for openings in common electrodes near data lines of display screens.

BACKGROUND OF THE DISCLOSURE

Display screens of various types of technologies, such as liquid crystal displays (LCDs), organic light emitting diode (OLED) displays, etc., can be used as screens or displays for a wide variety of electronic devices, including such consumer electronics as televisions, computers, and handheld devices (e.g., cellular telephones, audio and video players, gaming systems, and so forth). LCD devices, for example, typically provide a flat display in a relatively thin package that is suitable for use in a variety of electronic goods. In addition, LCD devices typically use less power than comparable display technologies, making them suitable for use in battery-powered devices or in other contexts where it is desirable to minimize power usage.

LCD devices typically include multiple picture elements (pixels) arranged in a matrix. The pixels may be driven by scanning line and data line circuitry to display an image on the display that can be periodically refreshed over multiple image frames such that a continuous image may be perceived by a user. Individual pixels of an LCD device can permit a variable amount light from a backlight to pass through the pixel based on the strength of an electric field applied to the liquid crystal material of the pixel. The electric field can be generated by a difference in potential of two electrodes, a common electrode and a pixel electrode. In some LCDs, such as electrically-controlled birefringence (ECB) LCDs, the liquid crystal can be in between the two electrodes. In other LCDs, such as in-plane switching (IPS) and fringe-field switching (FFS) LCDs, the two electrodes can be positioned on the same side of the liquid crystal. In many displays, the direction of the electric field generated by the two electrodes can be reversed periodically. For example, LCD displays can scan the pixels using various inversion schemes, in which the polarities of the voltages applied to the common electrodes and the pixel electrodes can be periodically switched, i.e., from positive to negative, or from negative to positive. As a result, the polarities of the voltages applied to various lines in a display panel, such as data lines used to charge the pixel electrodes to a target voltage, can be periodically switched according to the particular inversion scheme.

SUMMARY

With respect to liquid crystal display inversion schemes, a large change in voltage on a data line can affect the voltages on adjacent data lines due to capacitive coupling between data lines. The resulting change in voltage on these adjacent data lines can give rise to visual artifacts in the data lines' corresponding sub-pixels. However, not all sub-pixels will have lasting visual artifacts. For example, the brightening or darkening of a sub-pixel may not result in a lasting artifact if the sub-pixel's data line is subsequently updated to a target data voltage during the updating of the sub-pixel's row in the current frame. This subsequent update can overwrite the changes in voltage that caused these visual artifacts. In contrast, visual artifacts may persist in sub-pixels that have already been written with data in the current frame because the brightening or darkening can remain until the sub-pixel is updated again in the next frame.

Various embodiments of the present disclosure serve to prevent or reduce these visual artifacts by applying voltage to a data line more than once during the write sequence. Doing so can allow erroneous brightening or darkening caused by large voltage swings to be overwritten without causing additional large voltage swings on the data line.

BRIEF DESCRIPTION OF THE DRAWINGS

FIG. 3A illustrates an example one-column inversion scheme according to embodiments of the disclosure.

FIG. 3B illustrates an example two-column inversion scheme according to embodiments of the disclosure.

FIG. 3C illustrates an example three-column inversion scheme according to embodiments of the disclosure.

FIG. 7 illustrates an example four-line reordered line inversion scheme according to embodiments of the disclosure.

FIG. 8A illustrates an example dot inversion scheme according to embodiments of the disclosure.

FIG. 8B illustrates an example two-column multi-dot inversion scheme according to embodiments of the disclosure.

FIG. 8C illustrates an example three-column multi-dot inversion scheme according to embodiments of the disclosure.

DETAILED DESCRIPTION

In the following description of exemplary embodiments, reference is made to the accompanying drawings in which it is shown by way of illustration, specific embodiments, of the disclosure. It is to be understood that other embodiments can be used and structural changes can be made without departing from the scope of the embodiments of the disclosure.

Furthermore, although embodiments of the disclosure may be described and illustrated herein in terms of logic performed within a display driver, host video driver, etc., it should be understood that embodiments of the disclosure are not so limited, but can also be performed within a display subassembly, liquid crystal display driver chip, or within another module in any combination of software, firmware, and/or hardware.

With respect to liquid crystal display inversion schemes, a large change in voltage on a data line can affect the voltages on adjacent data lines due to capacitive coupling between data lines. The resulting change in voltage on these adjacent data lines can give rise to visual artifacts in the data lines' corresponding sub-pixels. Various embodiments of the present disclosure serve to prevent or reduce these visual artifacts by applying voltage to a data line more than once during the write sequence. Doing so can allow erroneous brightening or darkening caused by large voltage swings to be overwritten without causing additional large voltage swings on the data line.

Figure 1C:
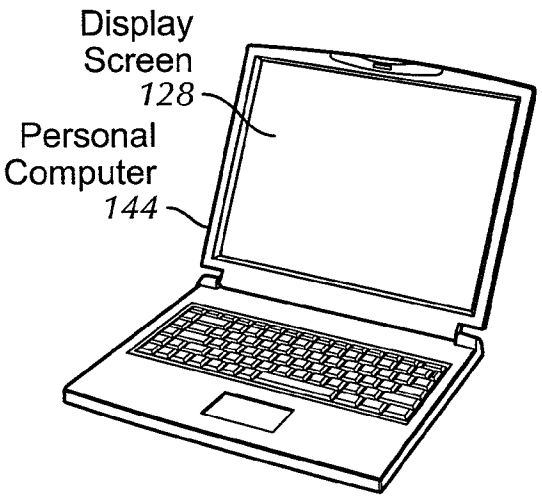
FIG. 1C illustrates an example personal computer according to embodiments of the disclosure.
Figure 1B:
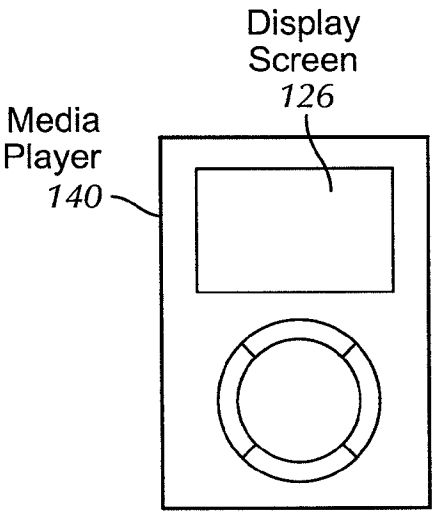
FIG. 1B illustrates an example digital media player according to embodiments of the disclosure.
Figure 1A:
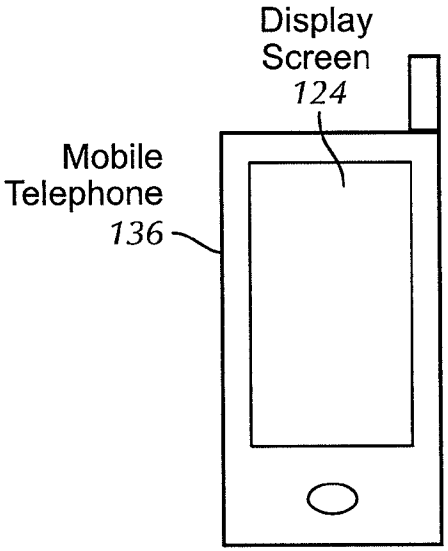
FIG. 1A illustrates an example mobile telephone according to embodiments of the disclosure.
Figure 1D:
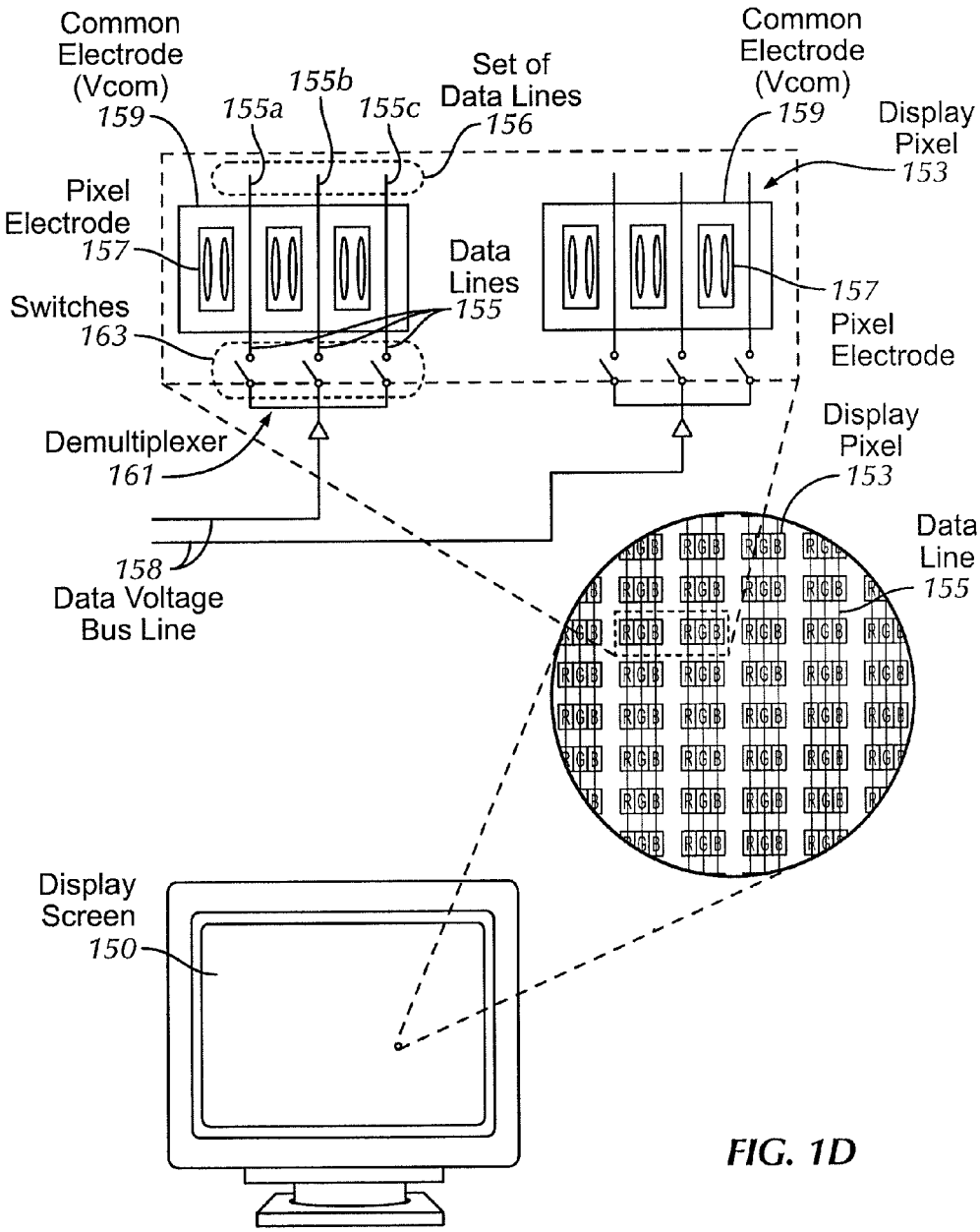
FIG. 1D illustrates an example display screen according to embodiments of the disclosure.

FIGS. 1A-1D show example systems in which display screens (which can be part of touch screens) according to embodiments of the disclosure may be implemented. FIG. 1A illustrates an example mobile telephone 136 that includes a display screen 124. FIG. 1B illustrates an example digital media player 140 that includes a display screen 126. FIG. 1C illustrates an example personal computer 144 that includes a display screen 128. FIG. 1D illustrates an example display screen 150, such as a stand-alone display. In some embodiments, display screens 124, 126, 128, and 150 can be touch screens in which touch sensing circuitry can be integrated into the display pixels. Touch sensing can be based on, for example, self capacitance or mutual capacitance, or another touch sensing technology. In some embodiments, a touch screen can be multi-touch, single touch, projection scan, full-imaging multi-touch, or any capacitive touch.

FIG. 1D illustrates some details of an example display screen 150. FIG. 1D includes a magnified view of display screen 150 that shows multiple display pixels 153, each of which can include multiple display sub-pixels, such as red (R), green (G), and blue (B) sub-pixels in an RGB display, for example. Data lines 155 can run vertically through display screen 150, such that a set 156 of three data lines (an R data line 155*a*, a G data line 155*b*, and a B data line 155*c*) can pass through an entire column of display pixels (e.g., vertical line of display pixels).

FIG. 1D also includes a magnified view of two of the display pixels 153, which illustrates that each display pixel can include pixel electrodes 157, each of which can correspond to one of the sub-pixels, for example. Each display pixel can include a common electrode (Vcom) 159 that can be used in conjunction with pixel electrodes 157 to create an electrical potential across a pixel material (not shown). Varying the electrical potential across the pixel material can correspondingly vary an amount of light emanating from the sub-pixel. In some embodiments, for example, the pixel material can be liquid crystal. A common electrode voltage can be applied to a Vcom 159 of a display pixel, and a data voltage can be applied to a pixel electrode 157 of a sub-pixel of the display pixel through the corresponding data line 155. A voltage difference between the common electrode voltage applied to Vcom 159 and the data voltage applied to pixel electrode 157 can create the electrical potential through the liquid crystal of the sub-pixel. The electrical potential can generate an electric field through the liquid crystal, which can cause inclination of the liquid crystal molecules to allow polarized light from a backlight (not shown) to emanate from the sub-pixel with a luminance that depends on the strength of the electric field (which can depend on the voltage difference between the applied common electrode voltage and data voltage). In other embodiments, the pixel material can include, for example, a light-emitting material, such as can be used in organic light emitting diode (OLED) displays.

In this example embodiment, the three data lines 155 in each set 156 can be operated sequentially. For example, a display driver or host video driver (not shown) can multiplex an R data voltage, a G data voltage, and a B data voltage onto a single data voltage bus line 158 in a particular sequence, and then a demultiplexer 161 in the border region of the display can demultiplex the R, G, and B data voltages to apply the data voltages to data lines 155*a*, 155*b*, and 155*c* in the particular sequence. Each demultiplexer 161 can include three switches 163 that can open and close according to the particular sequence of sub-pixel charging for the display pixel. In an R-G-B sequence, for example, data voltages can be multiplexed onto data voltage bus line 158 such that R data voltage is applied to R data line 155*a* during a first time period, G data voltage is applied to G data line 155*b* during a second time period, and B data voltage is applied to B data line 155*c* during a third time period. Demultiplexer 161 can demultiplex the data voltages in the particular sequence by closing switch 163 associated with R data line 155*a* during the first time period when R data voltage is being applied to data voltage bus line 158, while keeping the green and blue switches open such that G data line 155*b* and B data line 155*c* are at a floating potential during the application of the R data voltage to the R data line. In this way, for example, the red data voltage can be applied to the pixel electrode of the red sub-pixel during the first time period. During the second time period, when G data voltage is being applied to G data line 155*b*, demultiplexer 161 can open the red switch 163, close the green switch 163, and keep the blue switch 163 open, thus applying the G data voltage to the G data line, while the R data line and B data line are floating. Likewise, the B data voltage can be applied during the third time period, while the G data line and the R data line are floating.

As will be described in more detail below with respect to example embodiments, applying a data voltage to a data line can affect the voltages on surrounding, floating data lines. In some cases, the effect on the voltages of floating data lines can affect the luminance of the sub-pixels corresponding to the affected data lines, causing the sub-pixels to appear brighter or darker than intended. The resulting increase or decrease in sub-pixel luminance can be detectable as a visual artifact in some displays.

In some embodiments, thin film transistors (TFTs) can be used to address display pixels, such as display pixels 153, by scanning lines of display pixels (e.g., rows of display pixels) in a particular order. When each line is updated during the scan of the display, data voltages corresponding to each display pixel in the updated line can be applied to the set of data lines of the display pixel through the demuxing procedure described above, for example.

Figure 2:
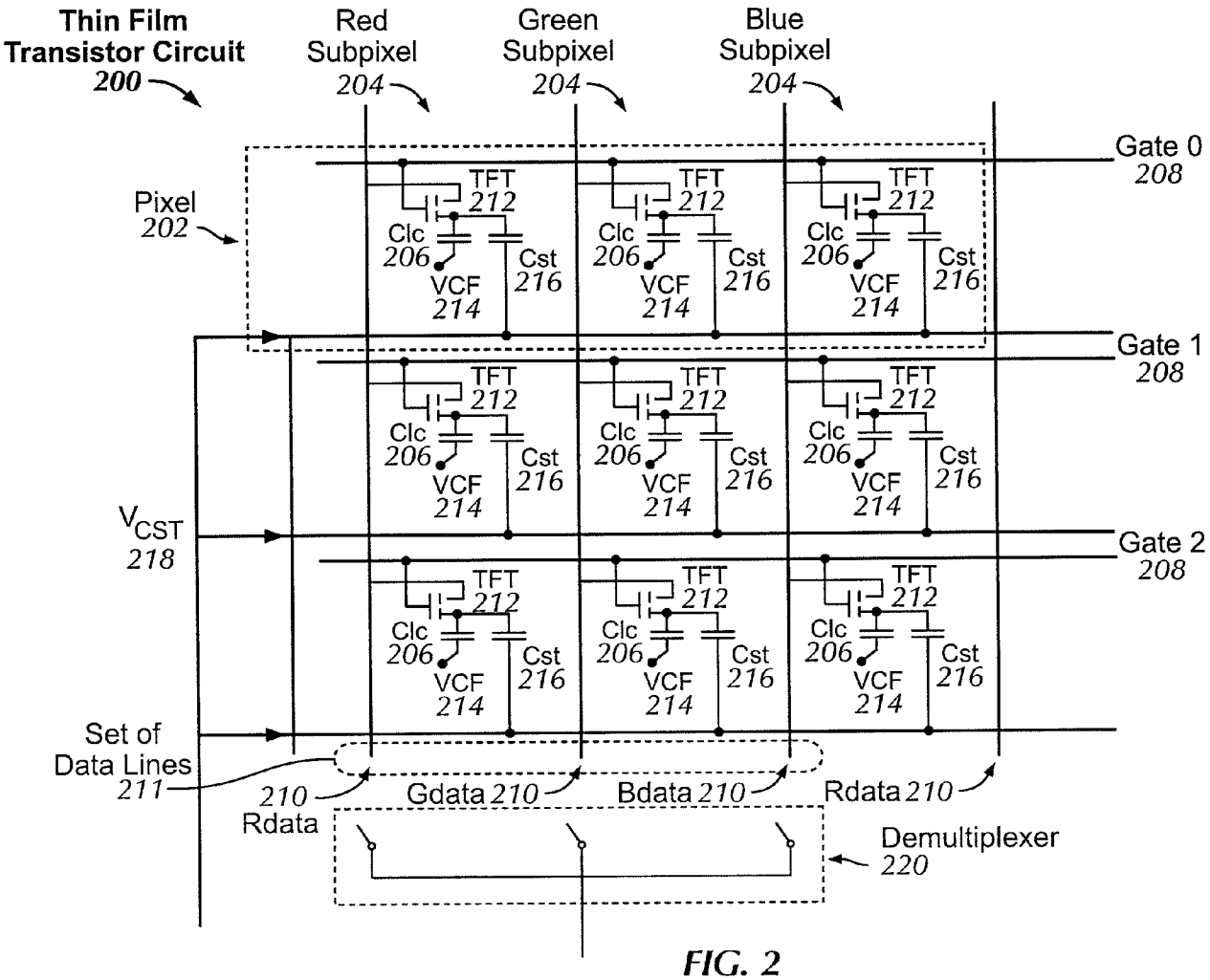
FIG. 2 illustrates an example thin film transistors (TFT) circuit according to embodiments of the disclosure.

FIG. 2 illustrates a portion of an exemplary TFT circuit 200 according to embodiments of the present disclosure. As shown by the figure, the thin film transistor circuit 200 can include multiple pixels 202 arranged into rows, or scan lines, with each pixel 202 containing a set of color sub-pixels 104 (red, green, and blue, respectively). It is understood that a plurality of pixels can be disposed adjacent each other to form a row of the display. Each color reproducible by the liquid crystal display can therefore be a combination of three levels of light emitted from a particular set of color sub-pixels 204.

Color sub-pixels may be addressed using the thin film transistor circuit's 200 array of scan lines (called gate lines 208) and data lines 210. Gate lines 208 and data lines 210 formed in the horizontal (row) and vertical (column) directions, respectively, and each column of display pixels can include a set 211 of data lines including an R data line, a G data line, and a B data line. Each sub-pixel may include a pixel TFT 212 provided at the respective intersection of one of the gate lines 208 and one of the data lines 210. A row of sub-pixels may be addressed by applying a gate signal on the row's gate line 208 (to turn on the pixel TFTs of the row), and by applying voltages on the data lines 210 corresponding to the amount of emitted light desired for each sub-pixel in the row. The voltage level of each data line 210 may be stored in a storage capacitor 216 in each sub-pixel to maintain the desired voltage level across the two electrodes associated with the liquid crystal capacitor 206 relative to a voltage source 214 (denoted here as $V_{cf}$). A voltage $V_{cf}$ may be applied to the counter electrode (common electrode) forming one plate of the liquid crystal capacitance with the other plate formed by a pixel electrode associated with each sub-pixel. One plate of each of the storage capacitors 216 may be connected to a common voltage source Cst along line 218.

Applying a voltage to a sub-pixel's data line can charge the sub-pixel (e.g., the pixel electrode of the sub-pixel) to the voltage level of the applied voltage. Demultiplexer 220 in the border region of the display can be used to apply the data voltages to the desired data line. For example, demultiplexer 220 can apply data voltages to the R data line, the G data line, and the B data line in a set 211 in a particular sequence, as described above with reference to FIG. 1D. Therefore, while a voltage can be applied to one data line (e.g., red), the other data lines (e.g., green and blue) in the pixel can be floating. However, as described above, applying a voltage to one data line can affect the voltage on floating data lines, for example, because a capacitance existing between data lines can allow voltage changes on one data line to be coupled to other data lines. This capacitive coupling can change the voltage on the floating data lines, which can make the sub-pixels corresponding to the floating data lines appear either brighter or darker depending on whether the voltage change on the charging data line is in the same direction or opposite direction, respectively, as the polarity of the floating data line voltage. In addition, the amount of voltage change on the floating data line can depend on the amount of the voltage change on the charging data line.

By way of example, a negative data voltage, e.g., −2V, may be applied to data line A during the scan of a first line. Then, during the scan of the next line, a positive data voltage, e.g., +2V, may be applied to data line A, thus swinging the voltage on data line A from −2V to +2V, i.e., a positive voltage change of +4V. Voltages on floating data lines surrounding data line A can be increased by this positive voltage swing. For example, the positive swing on data line A can increase the voltage of an adjacent data line B floating at a positive voltage, thus, increasing the magnitude of the positive floating voltage and making the sub-pixel corresponding to data line B appear brighter. Likewise, the positive voltage swing on data line A can increase the voltage of an adjacent data line C floating at a negative voltage, thus, decreasing the magnitude of the negative floating voltage and making the sub-pixel corresponding to sub-pixel C appear darker. Thus, the appearance of visual artifacts of brighter or darker sub-pixels can depend on, for example, the occurrence of large voltage changes on one or more data lines during scanning of a display and the polarity of surrounding data lines with floating voltages during the large voltage changes.

In addition, the appearance of visual artifacts can depend on the particular sequence in which the data voltages are applied. Further to the example above, after a data voltage is applied to data line A, a data voltage may be applied to data line B (data line B being next in sequence). In this case, the effect of the voltage swing on data line A, i.e., the increase in the voltage on data line B, can be "overwritten" by the subsequent charging of data line B.

While the particular sequence in which the data voltages are applied to a set of data lines can be independent of the type of inversion scheme, the occurrence of large voltage changes in data lines, and the polarities of the floating voltages on adjacent data lines during the large voltage changes, can each depend on the type of inversion scheme used to operated the display. In some displays, a column inversion scheme, a line (row) inversion scheme, or a dot inversion scheme can be used, for example. Some example inversion schemes, and corresponding mechanisms that can introduce the display artifacts described above, will now be described.

Column Inversion

In a column inversion scheme, for example, the polarity of the data voltages applied to a particular data line can remain the same throughout the scan of all of the rows of the display in one frame update, i.e., an update of the displayed image by scanning through all of the rows to update the voltages on each sub-pixel of the display. In other words, while the particular voltage values applied to a particular data line can change from one row scan to another row scan, the polarity of the data voltages on the particular data line can remain the same throughout the scan. In the next frame, the polarity of the data voltages can be reversed, for example. In other words, polarity changes on data line voltage may only occur in between frames. Therefore, large voltage changes (e.g., a swing in voltage from one polarity to another polarity) on a data line may only occur during the scan of the first line of a new frame, for example.

While the polarity of the data line voltages applied to each data line can remain the same throughout the scan of a single frame in column inversion, the polarity of the voltage applied to each data line can alternate across a scanned row of sub-pixels; i.e., during a scan of one row, positive polarity data voltages can be applied to some of the data lines and negative polarity data voltages can be applied to the other data lines.

This alternating pattern is illustrated in FIG. 3A which shows columns with voltages of alternating polarities. As described above, the polarity of the voltage can remain the same along a column but alternate across a row. In the next frame, the polarity of the data voltages can be reversed. As is known in the art, other column inversion schemes, including two-column inversion illustrated in FIG. 3B, and three-column inversion illustrated in FIG. 3C, can operate according to similar principles.

Figure 4A:
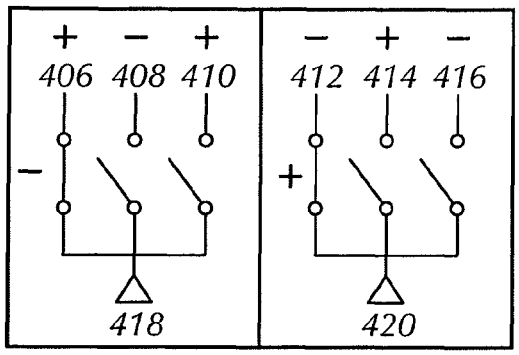
FIGS. 4A, 4B, and 4C illustrate an example alternating voltage polarity pattern across two adjacent pixels according to an embodiment of a column inversion scheme.
Figure 4B:
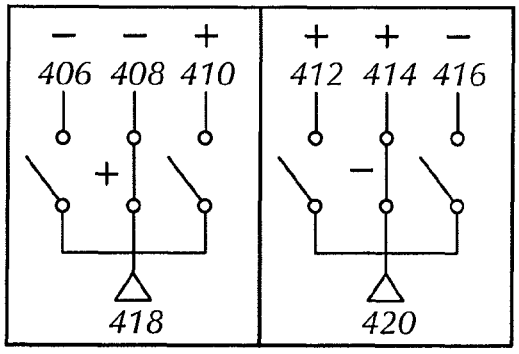
Figure 4C:
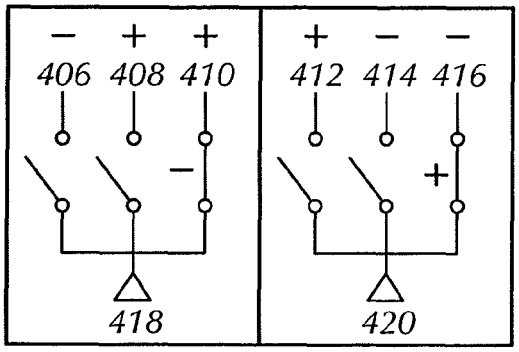

FIGS. 4A, 4B, and 4C illustrate an example alternating voltage polarity pattern across a scanned row in one embodiment of a column inversion scheme. FIGS. 4A, 4B, and 4C illustrate two adjacent pixels 402 and 404 along the same row at different points in time, T0, T1, and T2, during a scan of the row. Pixel 402 has a red sub-pixel with red data line 406, a green sub-pixel with green data line 408, and a blue sub-pixel with blue data line 410. A demultiplexer 418 located in the border region of the display can operate the data lines of pixel 402. The demultiplexer receives the RGB data signals for each sub-pixel and feeds each signal to the appropriate RGB data line at the appropriate timing as dictated by timing and control circuitry (not shown), for example, as described above. Pixel 404 has a similar structure. Although writing, i.e., application of data voltages to the data lines, may occur in any sequence, the embodiment shown in FIGS. 4A, 4B, and 4C uses an RGB write sequence.

An RGB write sequence for the sub-pixels may be applied simultaneously to each sub-pixel in a row of the display during the scan of the row. After the scan of the row is complete, a next row in the scanning order can be likewise scanned. The scanning process can continue scanning rows in a particular scanning order until all of the rows of the display are refreshed, i.e., a single frame update.

The RGB write sequence first writes data to each red sub-pixel in the row at time T0; next writes data to each green sub-pixel in the row at time T1; and finally writes data to each blue sub-pixel in the row at time T2. To accomplish this writing sequence, demultiplexers select the desired sub-pixel for writing, while a voltage is then applied to the sub-pixel's corresponding data line. As shown in FIGS. 4A, 4B, and 4C, a "+" or "−" is located above each sub-pixel data line. These signs represent the polarity of the sub-pixel's data line voltage value prior to writing. In the present example, pixels 402 and 404 may be in the first row scanned in a frame. In this example, the polarity of the data voltages can be reversed in between the previous frame and the new frame. Therefore, the "+" or "−" sign above each sub-pixel data line shows the prior voltage polarity from the previous update. This polarity is opposite to the polarity of the voltage applied in the current update. In this case, the data line voltages applied in the scan of this first row can result in a large voltage change in each data line, as the voltage on each data line can swing from + to − or from − to +.

FIG. 4A, for example, illustrates the writing of data to the red sub-pixels by application of a voltage to red data lines 406 and 412 at time T0. As illustrated, demultiplexers 418 and 420 apply a voltage to the red data lines. Doing so changes the polarity of the voltages on red data line 406 from + to − and from − to + on red data line 412. Because the voltages applied to the red data lines can swing the data line voltages from one polarity to the opposite polarity, the voltage change on the red data lines can be large during the scan of the first row in a new frame, as compared to the voltage changes occurring in the red data lines during the scans of subsequent rows in the new frame. While a voltage is being applied to the red data lines, the green and blue data lines are floating. For reasons similar to those described in more detail below with respect to FIG. 4B, the large voltage changes in the red data lines can affect the voltages on the green and blue data lines. However, in the present example, the red sub-pixels can be written prior to the green and blue sub-pixels in the RGB sequence. Therefore, because the green sub-pixels can be written immediately after the red sub-pixels, and the blue sub-pixels can be written immediately after the green sub-pixels, any effect from the large voltage change on the red data lines can be quickly eliminated when the green and blue sub-pixels are charged to their desired voltages. The effect of the voltage changes on the red data line may not cause visual artifacts on the green and blue data lines' corresponding sub-pixels because this effect may be written over so quickly.

FIG. 4B illustrates the writing of data to the green sub-pixels by application of a voltage to green data lines 408 and 414 at time T1. As illustrated, demultiplexers 418 and 420 apply a voltage to the green data lines. Doing so changes the polarity of the voltage on green data line 408 from − to + and the polarity of the voltage on green data line 414 from + to −. While these voltages are applied to the green data lines, the red and blue data lines are floating.

The large voltage change on the green data lines can affect the voltages on the red and blue data lines, for example, due to capacitive coupling between data lines. In particular, the capacitance existing between two data lines can allow voltage changes on one data line to affect the voltages on other data lines. While there may be some amount of capacitance existing between a particular data line and each and every other data line, the amount of capacitance can vary depending on the distance between two data lines and may be greatest between two adjacent data lines. In this regard, the change in voltage on the green data line can affect the voltage levels on the two adjacent floating red and blue data lines. In this example, the large positive voltage change on green data line 408 swings the polarity from − to +. This positive voltage difference can cause a positive voltage change in red data line 406. Because the polarity of red data line 406 voltage is negative, the positive voltage change on green data line 408 can reduce the magnitude of the red data line 406 voltage, which can make the red sub-pixel of pixel 402 appear darker. The voltage on green data line 414 is similarly affected. In this example, the large negative voltage change on green data line 414 swings the polarity from + to −. This negative voltage difference can cause a negative voltage change in red data line 412. Because the polarity of red data line 412 is positive, the negative voltage change on green data line 414 can reduce the magnitude of the red data line 414 voltage, which can make the red sub-pixel of pixel 404 appear darker.

The change in voltages on the green data lines also affects the voltage levels of the blue sub-pixels corresponding to data lines 410 and 416. However, as described above with respect to red sub-pixel charging, this affect on the blue data voltage line may not cause any visual artifacts because data is written to the blue data lines at the next time step T2.

FIG. 4C illustrates the writing of data to the blue sub-pixels by application of a voltage to blue data lines 410 and 416. Just as above, demultiplexers 418 and 420 apply a voltage to the blue data lines. Doing so changes the polarity of the voltages on the blue data lines from + to − on data line 410 and from − to + on data line 416. This change in voltage also affects the voltage levels of the red and green data lines.

In this example, the large negative change in voltage on blue data line 410 swings the polarity from + to −. This negative voltage change can cause a negative voltage change on green data line 408. Because the polarity of green data line 408 is positive, the negative voltage change can reduce the magnitude of the green data line voltage, which can make the green sub-pixel appear darker. Similarly, the large negative voltage change on blue data line 410 can reduce the magnitude of the + voltage on red data line 412 in the adjacent pixel, which can make the red sub-pixel appear darker.

The large negative change in voltage on blue data line 410 can also affect the voltage on red data line 406. Because the polarity of the red data line 406 is negative, the negative voltage change on the blue data line can increase the magnitude of the red data line voltage, which can make the red sub-pixel appear brighter. However, as explained above with respect to FIG. 4B, capacitive coupling between green data line 408 and red data line 406 can cause the red sub-pixel to appear darker. As such, voltage swings on both the green and blue data lines can create visual artifacts on the red sub-pixel, albeit in different directions. However, because the distance between the green and red data lines is smaller than the distance between the blue and red data lines, there can be a stronger mutual capacitance between the closer pair of data lines than the more distant pair of data lines. Accordingly, the darkening caused by the green data line can have a stronger impact and may be more noticeable than the brightening caused by the blue data line.

In a similar fashion, the large positive change in voltage on blue data line 416 swings the polarity from – to +. This positive voltage change can cause a positive voltage change on green data line 414. Because the polarity of green data line 414 is negative, the positive voltage change can reduce the magnitude of the green data line voltage, which can make the green sub-pixel appear darker.

Moreover, the positive voltage change on blue data line 416 can affect the voltage on red data line 412. Because the polarity of red data line 412 is positive, the positive increase in voltage on the blue data line can increase the magnitude of the red data line voltage, which can make the red sub-pixel appear brighter. However, as explained above, this red sub-pixel appears darker because of the changes in voltage on blue data line 410 and green data line 414. Because blue data line 416 is farther away from red data line 412 than both blue data line 410 and green data line 414, the brightening effect from the change in voltage on the blue data line 416 may not be as noticeable as the darkening effects from the change in voltage on blue data line 410 and green data line 414.

In this example, FIGS. 4A, 4B, and 4C illustrate two adjacent pixels on the first line of pixels in a display panel. After data is written to the blue data lines on the first line of pixels, the display driver or host video driver can begin scanning the second line of pixels. However, unlike the first line of pixels, visual artifacts may not appear in the second line or any subsequent line of pixels scanned in the current frame by virtue of the column inversion scheme. As described above, in a column inversion scheme, the same voltage polarity is applied to all sub-pixels along a data line during the scan of each frame, and this polarity can toggle to the opposite value in the next frame. Whether visual artifacts appear can depend on the change in voltage on the data line. Accordingly, the appearance of these artifacts can depend on the data line's current and previous voltage values (i.e., the difference in voltage). However, data lines run up and down the display panel alongside the columns. Because every sub-pixel in a column has the same voltage polarity, after the scan of the first row, any differences in voltage applied on a particular data line from one row to the next row in the scan can be small in comparison to the swing in voltage polarity required during the scan of the first row.

FIG. 3A, for example, illustrates this concept in a one-column inversion scheme. During the scan of Frame 1, for example, only negative polarity voltages are applied to the first column of sub-pixels, i.e., the leftmost column shown in the figure. At the end of the scan of Frame 1, the voltage of the last sub-pixel in the first column is negative, for example. In other words, at the end of Frame 1, the last voltage applied to the first data line, i.e., the data line that writes into the first column, has a negative polarity voltage. When the first row of pixels in scanned during Frame 2, the polarity on the first data line toggles to a positive voltage. As explained above, the presence of artifacts can depend on the change in voltage on the data line (i.e., the difference between the voltage currently applied and the data line's preceding voltage). The data line's preceding voltage is based on the last line scanned (i.e., the last row in Frame 1) which had a negative polarity. As such, the voltage on the first data line toggles from a negative polarity to a positive polarity. This large voltage difference may create visual artifacts.

However, these artifacts may not be noticeable in subsequent lines of pixels. For example, when the second row of pixels is scanned during Frame 2, the voltage applied to the first data line is also at a positive polarity. Because this data line's preceding voltage also had a positive polarity, any change in voltage can be small. In general, switching from a positive voltage to another positive voltage (as with the second and subsequent lines in the scan of Frame 2) can yield a smaller voltage difference than switching from a negative voltage to a positive voltage (as with the first line in the scan of Frame 2). This relatively small voltage difference may not produce visual artifacts in the second line and subsequent lines of pixels. Although this example is based on a one-column inversion scheme, a person of ordinary skill in the art would recognize that the same principles can apply to other column inversion schemes including, for example, two-column inversion and three-column inversion as illustrated in FIGS. 3B and 3C, respectively.

Line (Row) Inversion

In line (row) inversion, the polarity of the voltages applied to the data lines during the scan of one row can be different from the polarity of the voltages applied during the scan of another row in the same frame. In contrast to column inversion, large changes in data voltages can occur for multiple scan lines due to multiple changes in polarity throughout the scanning of a single frame. Capacitive coupling between data lines can also introduce visual artifacts in line inversion schemes.

Figure 5A:
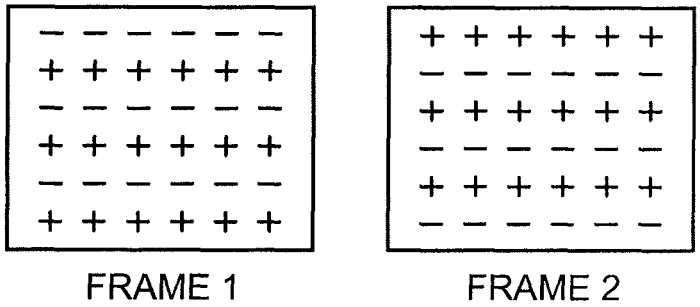
FIG. 5A illustrates an example one-line inversion scheme according to embodiments of the disclosure.
Figure 5B:
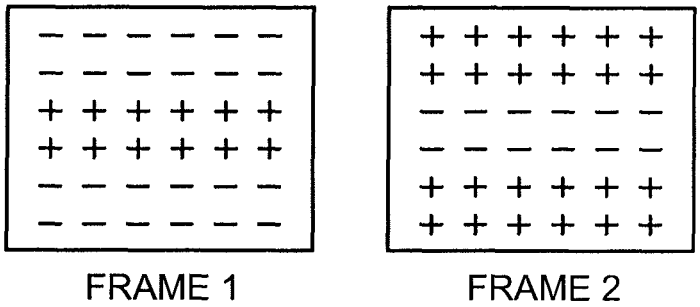
FIG. 5B illustrates an example two-line inversion scheme according to embodiments of the disclosure.

In line inversion, the polarity of the voltage on each sub-pixel is the same for all sub-pixels in the same row, and this polarity alternates from row to row. This configuration is illustrated in FIG. 5A. In the next frame, the polarity of the data voltages can be reversed. As is known in the art, other line inversion schemes, including two-line inversion illustrated in FIG. 5B, and three-line inversion illustrated in FIG. 5C, can operate according to similar principles. In two-line inversion, every block of two rows can have the same polarity. In three-line inversion, every block of three rows can have the same polarity.

Figure 6A:
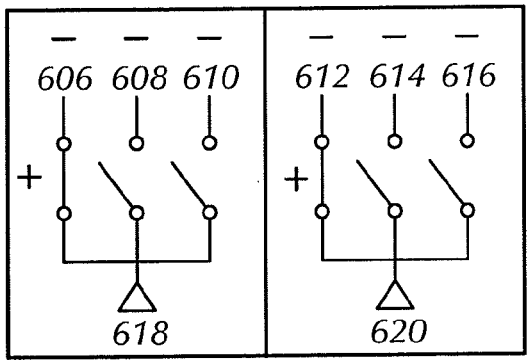
FIGS. 6A, 6B, and 6C illustrate an example constant voltage polarity pattern across two adjacent pixels in a line inversion scheme according to embodiments of the disclosure.
Figure 6B:
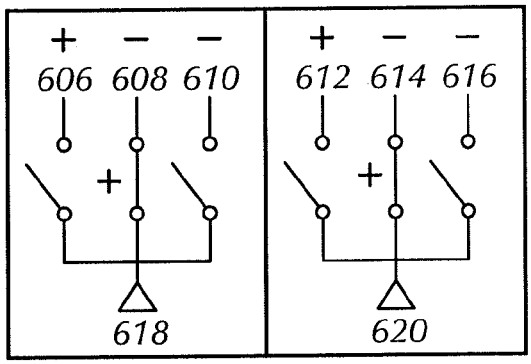
Figure 6C:
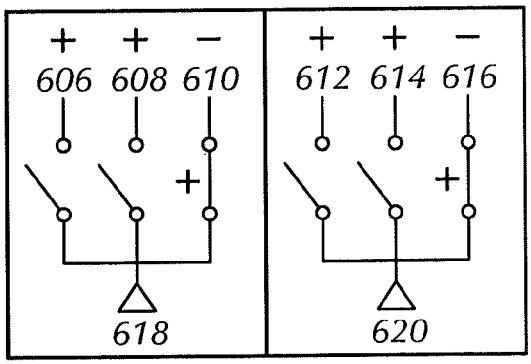

FIGS. 6A, 6B, and 6C illustrate an example of a constant voltage polarity pattern across a scanned row in one embodiment of a line inversion scheme. FIGS. 6A, 6B, and 6C illustrate two adjacent pixels 602 and 604 arranged along the same row at different points in time, T0, T1, and T2, during a scan of the row. Pixel 602 has a red sub-pixel with red data line 606, a green sub-pixel with green data line 608, a blue sub-pixel with blue data line 610. A demultiplexer 618 located in the border region of the display can operate the data lines of pixel 602. The demultiplexer receives the RGB data signals for each sub-pixel and feeds each signal to the appropriate RGB data line at the appropriate timing as dictated by timing and control circuitry (not shown), for example, as described above. Pixel 604 has a similar structure. Although writing, i.e., application of data voltages to the sub-pixels, may occur in any sequence, the embodiment shown in FIGS. 6A, 6B, and 6C uses an RGB write sequence.

As explained above, an RGB write sequence for the sub-pixels may be applied simultaneously to each sub-pixel in a row of the display during the scan of the row. After the scan of the row is complete, a next row in the scanning order can be likewise scanned until all of the rows of the display are refreshed, i.e., a single frame update.

The RGB write sequence first writes data to each red sub-pixel in the row at time T0; next writes data to each green sub-pixel in the row at time T1; and finally writes data to each blue sub-pixel in the row at time T2. To accomplish this writing sequence, demultiplexers select the desired sub-pixel for writing, while a voltage is then applied to the sub-pixel's corresponding data line. As shown in FIGS. 6A, 6B, and 6C, a "+" or "−" is located above each data line. Like FIGS. 4A, 4B, and 4C, these signs represent the polarity of the sub-pixel's data line voltage value prior to writing. In the present example, pixels 602 and 604 may be in the first row scanned in a frame. In this example, the polarity of the data line voltages can be reversed in between the previous frame and the new frame. Therefore, the "+" or "−" sign above each data line shows the prior voltage polarity from the previous update. This polarity is opposite to the polarity of the voltage applied in the current update. In this case, the data line voltages applied in the scan of this first row can result in a large voltage change in each data line, as the voltage on each data line can swing from + to − or from − to +.

FIG. 6A, for example, illustrates the writing of data to the red sub-pixels by application of a voltage to red data lines 606 and 612 at time T0. As illustrated, demultiplexers 618 and 620 apply a voltage to red data lines 606 and 612. Doing so changes the polarity of the voltages on red data lines 606 and 612 from − to +. Because the voltages applied to the red data lines can swing the data line voltages from one polarity to the opposite polarity, the voltage change on the red data lines can be large during the scan of the first row in each update block. While these voltages are applied to the red data lines, the green and blue data lines can be floating. As such, the large voltage changes on the red data lines can affect the voltages on the green and blue data lines. However, in the present example, the red sub-pixels can be written prior to the green and blue sub-pixels in the RGB sequence. Therefore, because the green sub-pixels can be written immediately after the red sub-pixels, and the blue sub-pixels can be written immediately after the green sub-pixels, any effect from the large voltage change on the red data lines can be quickly eliminated when the green and blue sub-pixels are charged to their desired voltages. The effect of the voltage changes on the red data line may not cause visual artifacts on the green and blue sub-pixels because this effect may be written over so quickly.

FIG. 6B illustrates the writing of data to the green sub-pixels by application of a voltage to green data lines 608 and 614 at time T1. As illustrated, demultiplexers 618 and 620 apply a voltage to the green data lines. Doing so changes the polarity of the voltages on the green data lines 608 and 614 from − to +. While these voltages are applied to the green data lines, the red and blue data lines can be floating.

The large voltage change on the green data lines can affect the voltages on the red and blue data lines, for example, due to capacitive coupling between data lines. In this example, the large positive voltage change on the green data lines 608 and 614 can swing the polarity from − to +. This positive voltage difference can cause a positive voltage change on red data lines 606 and 612. Because the polarity of the red data line voltage is positive, the positive voltage change can increase the magnitude of the red data line voltages, which can make the red sub-pixels appear brighter.

The change in voltage on the green data line also affects the voltage level of blue sub-pixels corresponding to data lines 610 and 616. However, as described above with respect to red sub-pixel charging, this affect on the blue data voltage line may not cause any visual artifacts because data is written to the blue data lines at the next time step T2.

FIG. 6C illustrates the writing of data to the blue sub-pixels by application of a voltage to blue data lines 610 and 616. Just as above, demultiplexers 618 and 620 can apply a voltage to the blue data lines. Doing so changes the polarity of the voltages on blue data lines 610 and 616 from − to +. This change in voltage also affects the voltages levels of the red and green data lines.

In this example, the large positive changes in voltage on blue data lines 610 and 616 swing the polarity on each data line from − to +. This positive voltage difference can cause a positive voltage change in green data line 608. Because the polarity of green data line 608 is positive, the positive voltage change can increase the magnitude of the green data line voltage, which can make the green sub-pixel appear brighter.

The large positive change in voltage on blue data line 610 can also affect the voltage on red data line 612. Because the polarity of the red data line 612 is positive, the positive voltage change on blue data line can increase the magnitude of the red data line voltage which can cause the corresponding red sub-pixel to appear brighter. However, as explained above, the change in voltage on green data line 614 at time T1 made this red sub-pixel appear brighter. Accordingly, this red sub-pixel can be brightened at both times T1 and T2. The change in voltage on blue data line 616 also affects the voltage on an unillustrated red data line adjacent to the blue data line in a similar manner.

These visual artifacts however, do not necessarily appear in every row of the display panel. Rather, the presence of these artifacts can depend on the type of line inversion scheme used. In a one-line inversion scheme, as illustrated in FIG. 5A, adjacent rows have voltages with different polarities. For example, during Frame 1 of FIG. 5A, rows 1, 3, and 5 have data lines with a negative voltage, and rows 2 and 4 have data lines with a positive voltage. In this inversion scheme, visual artifacts can appear in every row of the display because each time a row is scanned, the polarity of the voltages applied to the data lines is changed from its previous value which can result in a large voltage swing on each data line.

This effect, however, is different in higher numbered line inversion schemes. In higher numbered schemes, visual artifacts may not appear in every row. Rather, these artifacts can appear only on the first row of each block of rows of the same polarity. For example, in the two-line inversion scheme illustrated in FIG. 5B, only the first row in each block of two rows of the same polarity may have visual artifacts.

For example, during Frame 1, the data lines in rows 3 and 4 have positive voltage values. As explained above, whether visual artifacts appear can depend on the change in voltage on the data lines. The change in voltage on a data line can be represented by the current voltage on the data line minus the previous voltage on the data line. This previous voltage corresponds to the voltage on the data line when the data line was last updated during the scan of the previous row (i.e., row 2). In row 2, all data lines were updated to a negative voltage. During the scan of row 3, these data lines can be updated to a positive voltage. Changing the voltage from a negative polarity to a positive polarity can cause a large voltage change that can introduce brightening artifacts along row 3.

The updating of the data lines in row 4, however, may not create visual artifacts along row 4. During the scan of the previous row (i.e., row 3), the data lines were updated to a positive voltage. During the scan of row 4, the data lines can be updated to another positive value. Changing the voltage from a positive polarity to another positive polarity may not cause a large voltage change. As such, visual artifacts may not appear along row 4.

Figure 5C:
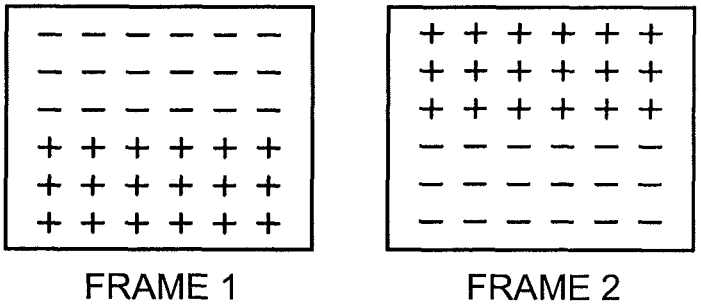
FIG. 5C illustrates an example three-line inversion scheme according to embodiments of the disclosure.

Although this example is based on a two-line inversion scheme, a person of ordinary skill in the art would recognize that the same principles apply to other higher numbered line inversion schemes including, for example, the three-line inversion method illustrated in FIG. 5C.

Reordered Line (Row) Inversion

Another type of inversion scheme is reordered line inversion, examples of which are disclosed in U.S. Patent Publication No. 2010/0195004, the contents of which are incorporated by reference herein in its entirety for all purposes. Unlike the row inversion methods discussed above, reordered line inversion may not scan each row in numerical order. Rather, rows in the display panel may be scanned based on the update sets in which they appear.

In reordered line inversion, update sets can be used to determine the scan order. Each row in an update set is separated from all other rows in the update set by at least one row. Like the line inversion techniques discussed above, different reordered line inversion schemes may be used including, for example, two-line and four-line reordered inversion.

Referring now to FIG. 7, an example four-line reordered line inversion scheme will now be described. This figure illustrates a display panel with varying positive and negative voltage values on different rows. To the left of the display panel is an index of row numbers. To the right of the display panel is the update set to which the row belongs. Because this example uses a four-row reordered inversion scheme, each update set includes four non-adjacent rows. The first update set includes rows 0, 2, 4, and 6. The second update set includes rows 1, 3, 5, and 7. The third update set includes rows 8, 10, 12, and 14. The fourth update set includes rows 9, 11, 13, and 15.

The order in which the rows are scanned may be based on each row's update set. Each row in an update set can be scanned before proceeding to the next update set. In this example, the rows in the first update set may be scanned first. The rows in the second update set may be scanned second, and so on for the rows in the third and fourth update sets.

Accordingly, in this example, the rows can be scanned in the following order: 0, 2, 4, 6, 1, 3, 5, 7, 8, 10, 12, 14, 9, 11, 13, and 15. Unlike the line inversion schemes discussed above, which scan each row in numerical order, reordered line inversion scans rows based on the update set to which the row belongs.

Despite the different scan orders, visual artifacts may appear in reordered line inversion for at least the same reasons discussed above with respect to non-reordered line inversion. Specifically, in each update set, bright line artifacts may appear only in the first row.

This effect may be explained, for example, by referring to update set 2 in the four-row reordered inversion scheme illustrated in FIG. 7. As illustrated, update set 2 includes rows 1, 3, 5, and 7. Each of these rows has data lines with a negative voltage polarity after they are updated.

Referring to row 1, whether visual artifacts appear can depend on the change in voltage on the data lines in this row. These data lines were previously updated to a positive voltage during the scan of the previous line (i.e., row 6 in update set 1). Because the data lines in row 1 are now updated to a negative voltage, the voltage toggles from a positive polarity to a negative polarity. Changing the voltage from a positive polarity to a negative polarity can cause a large voltage change that can introduce brightening artifacts along row 1.

However, these brightening artifacts may not appear in rows 3, 5, and 7. With respect to row 3, the voltage on the data lines in row 3 were previously updated to a negative voltage during the scan of the previous line (i.e., row in the same update set). During the scan of row 3, these data lines can be updated to another negative value. Accordingly, the change in voltage on the data lines in row 3 may be small. The same can be true for the change in voltage on the data lines in rows 5 and 7. As such, visual artifacts may not appear in rows 3, 5, and 7.

Although this example is based on a four-row reordered inversion scheme, a person of ordinary skill in the art would recognize that the same principles apply to other higher numbered reordered line inversion schemes.

Dot Inversion

A dot inversion scheme combines both line inversion and column inversion. Accordingly, the polarity of the data voltages applied to the data lines can be inverted along every data line as well as every row. In the next frame, the polarity of the data voltage can be reversed. This configuration is illustrated in FIG. 8A which shows, for example, alternating rows and columns of + and − voltages. In the next frame, the polarity of the data voltages can be reversed. As is known in the art, other dot inversion schemes, including two-column multi-dot inversion illustrated in FIG. 8B, and three-column multi-dot inversion illustrated in FIG. 8C, can operate according to similar principles.

With respect to each row of the display panel, the dot inversion schemes illustrated in FIGS. 8A, 8B, and 8C can resemble column inversion schemes. In the first row of the dot inversion scheme illustrated in FIG. 8A, for example, there are alternating columns of + and − voltages. This configuration is similar to using a one-column inversion scheme along the row. Similar patterns may apply to FIGS. 8B and 8C. In the first row of the two-column multi-dot inversion scheme illustrated in FIG. 8B, for example, alternating groups of two columns each have + and − voltages. This configuration is similar to using a two-column inversion scheme along each row. Similarly, each row of a three-column multi-dot inversion scheme may resemble a three-column inversion scheme.

In view of the similarity between dot inversion and column inversion, the same visual artifacts described above with respect to column inversion can also apply to each row of a dot inversion scheme.

As explained above with respect to the different inversion schemes, a large change in voltage on a data line can affect the voltages on adjacent data lines due to capacitive coupling between data lines. The resulting change in voltage on these adjacent data lines can give rise to visual artifacts in the data lines' corresponding sub-pixels. However, not all sub-pixels will have lasting visual artifacts. For example, the brightening or darkening of a sub-pixel may not result in a lasting artifact if the sub-pixel's data line is subsequently updated to a target data voltage during the updating of the sub-pixel's row in the current frame. This subsequent update can overwrite the changes in voltage that caused these visual artifacts. In contrast, visual artifacts may persist in sub-pixels that have already been written with data in the current frame because the brightening or darkening can remain until the sub-pixel is updated again in the next frame. Various embodiments of the present disclosure serve to prevent or reduce these visual artifacts by applying voltage to a data line more than once during the write sequence. As will be described in more detail below, doing so can allow erroneous brightening or darkening caused by large voltage swings to be overwritten without causing additional large voltage swings on the data line.

By way of example, a method of multiple voltage applications may be used in the one-column inversion scheme discussed above. FIGS. 9A, 9B, 9C, 9D, and p9E illustrate pixel 900 at different points in time, T0, T1, T2, T3, and T4, during a scan of the pixel's row. Pixel 900 has a red sub-pixel with red data line 902, a green sub-pixel with green data line 904, and a blue sub-pixel with blue data line 906. A demultiplexer 908 located in the border region of the display receives the R, G, and B data signals for each sub-pixel and applies a voltage to the appropriate R, G, or B data line at the appropriate time as dictated by timing and control circuitry (not shown).

Figure 9A:
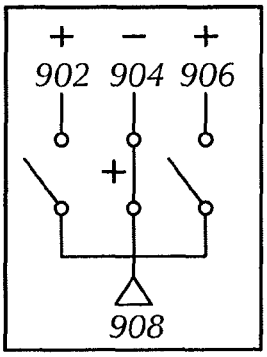
FIGS. 9A, 9B, 9C, 9D, and 9E illustrate an example of multiple voltage applications in a one-column inversion scheme according to embodiments of the disclosure.

FIG. 9A illustrates a first application of voltage to the green data line at time T0. Application of a positive voltage can change the polarity on the green data line 904 from negative to positive. The voltage applied to the green data line may, for example, be equal to the target voltage required for the image being displayed. The positive voltage swing on green data line 904 can cause an increase in the positive voltages on red data line 902 and blue data line 906 that can result in an increase in the brightness of the red and blue sub-pixels, as described above. However, because the voltages of the red and blue sub-pixels will be subsequently updated during the updating of the row in the current frame, the voltages corresponding to the increased brightness of the sub-pixels can be overwritten before they are detectable as visual artifacts.

Figure 9B:
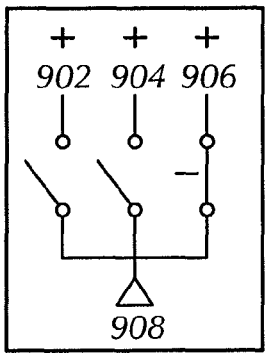

At time T1, demultiplexer 908 can apply a first application of voltage to blue data line 906 as illustrated in FIG. 9B. Application of this negative voltage can change the polarity on the blue data line from positive to negative. The voltage applied to the blue data line may, for example, be equal to the target voltage required for the image being displayed. The negative voltage swing on blue data line 906 can cause a decrease in the positive voltages on green data line 904 that can result in a darkening of the green sub-pixel. The negative voltage swing on blue data line 906 can similarly decrease the voltage of a red date line in an adjacent pixel (not shown). However, in this example embodiment, voltage will be applied to green data line 904 more than once, e.g., a second application of voltage. Therefore, because the voltages of the green sub-pixel of pixel 900 and the red sub-pixel of the adjacent pixel will be subsequently updated during the updating of the row in the current frame, the changed voltages of the sub-pixels can be overwritten before they are detectable as visual artifacts.

Figure 9C:
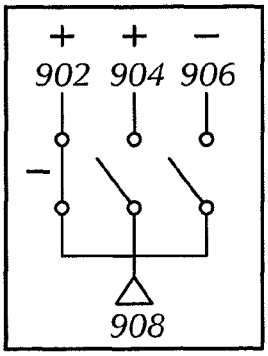

FIG. 9C illustrates the application of voltage to red data line 902 at time T2. Demultiplexer 908 can apply a negative target voltage to this data line. Because the voltage applied to the red data line can swing the polarity from positive to negative, the voltage change on the red data line can be large. As discussed above, large changes in voltage on one data line can affect the voltage level on other data lines. Here, the large change in voltage on the red data line can change the voltage on green data line 904 and blue data line 906. However, in the present example, data is written to the red sub-pixel at time T2 prior to the green and blue sub-pixels at times T3 and T4, respectively. Because data can be written to the green sub-pixel immediately after the red sub-pixel, and to the blue sub-pixel immediately after the green sub-pixel, any affect from the large voltage change on the red data line can be quickly overwritten when data is later written to the green and blue data. Accordingly, the voltage change on the red data line does not create any lasting visual artifacts on the green and blue sub-pixels. In addition, it is understood that the change in voltage on red data line 902 can also affect the voltage on an adjacent blue data line (not shown). However, these effects are negligible because the voltage on this unillustrated blue data line can be subsequently overwritten in a manner similar to blue data line 906.

Figure 9D:
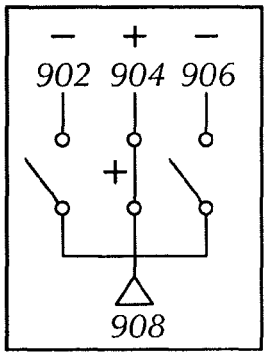

FIG. 9D illustrates the second application of voltage to green data line 904 at time T3. Demultiplexer 908 can apply a positive target voltage to green data line 904. However, because the existing voltage on green data line 904 is a positive voltage, due to the first application of voltage to the green data line a T0, the change in voltage on the green data line can be relatively small compared to a change from a correspondingly negative voltage to a positive voltage. This relatively small voltage change on the green data line can create little, if any, impact to the voltage levels on the red and blue data lines.

Figure 9E:
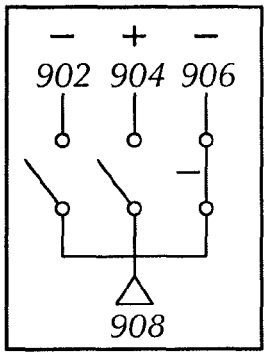

FIG. 9E illustrates a second application of voltage to blue data line 906 at time T4. Demultiplexer 908 can apply a negative target voltage to the blue data line. However, a negative voltage was previously applied to the blue data line at time T1. The change from one negative voltage to another negative voltage may be relatively small. Accordingly, any change in voltage on the blue data line due to the second application of voltage may also be small. The small voltage change on the blue data line can create little, if any, impact to the voltage levels on green data line 904 and a red data line adjacent to blue data line 906 (not shown). As such, the presence of visual artifacts in the red and green sub-pixels can be reduced or eliminated.

In the embodiment described above, voltage can be applied to the red data line once, to the green data line twice, and to the blue data line twice. Applying voltage to the green and blue data lines more than once can allow erroneous brightening or darkening caused by large voltage swings to be overwritten without causing additional large voltage swings in the data lines, i.e., without introducing new errors in sub-pixel brightness. This arrangement, in turn, can reduce or eliminate the appearance of visual artifacts. Although the above example embodiment uses a green-blue-red-green-blue write sequence (or more generally, a first line-second line-third line-first line-second line sequence), a person of ordinary skill in the art would recognize that other write sequences, for example, a red-green-blue-green-red write sequence (or more generally, a first line-second line-third line-second line-first line sequence), can yield similar effects.

Although the above example embodiment applies a voltage with a magnitude equal to the target value at each step in time, some embodiments can apply other voltages and/or other combinations of voltages, such as ground, a mid-level gray voltage, an overdrive voltage (described in more detail below), the target voltage, etc., in one or more of the voltage applications. For example, in FIG. 9A, zero volts (i.e., ground), instead of the target value, can be applied to green data line 904 at time T0. A positive voltage can be applied to the green data line again at time T3 to charge the green sub-pixel to its target voltage, and as a result, the voltage level can change from 0 volts to the positive target voltage at time T3. This change in voltage can be smaller than the change in voltage that would have occurred at time T3 if the green data line had not been grounded at time T0, because the previous voltage on the green data line was a negative voltage. In other words, in the case that the green line had not been grounded at time T0, the voltage on the green data line would have toggled from a negative polarity to a positive polarity, which could have created a large change in voltage. In other embodiments, zero volts may be applied to both the green and blue data lines, for example.

In the above example embodiment, voltage can be applied more than once for two data lines (i.e., the green and blue data lines); other embodiments may apply voltage more than once to other numbers of data lines. FIGS. 10A-10D illustrate an example embodiment in which voltage can be applied more than once for one data line. This arrangement can be useful, for example, for the example three-column inversion scheme illustrated in FIGS. 10A-10D. As explained above, in three-column inversion, every group of three adjacent data lines has the same polarity, and adjacent groups of data lines have different polarities. FIGS. 10A-10D illustrate two adjacent pixels 1000 and 1010 at different points in time, T1, T2, T3, and T4, during a scan of the pixels' row. Pixel 1010 has a red sub-pixel with red data line 1012, a green sub-pixel with green data line 1014, and a blue sub-pixel with blue data line 1016. A demultiplexer 1018 located in the border region of the display receives the R, G, and B data signals for each sub-pixel and feeds each signal to the appropriate R, G, or B data line at the appropriate timing as dictated by timing and control circuitry (not shown). Pixel 1000 is structurally similar to pixel 1010. Although only a blue sub-pixel with a blue data line 1006 is illustrated, it is understood that pixel 1000 also has a red sub-pixel with a red data line and a green sub-pixel with a green data line.

Figure 10A:
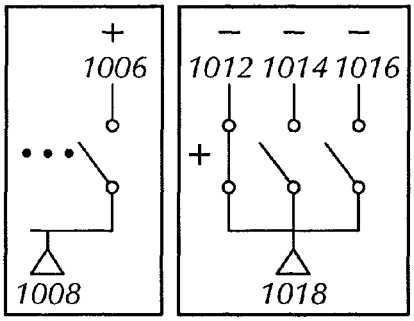
FIGS. 10A, 10B, 10C, and 10D illustrate an example of multiple voltage applications in a three-column inversion scheme according to embodiments of the disclosure.

At time T0, demultiplexer 1018 can apply a positive target voltage to red data line 1012, changing its polarity from negative to positive as illustrated in FIG. 10A. This large change in voltage can affect the voltage levels on green data line 1014 and blue data line 1006 and can create visual artifacts in their corresponding sub-pixels. However, subsequent applications of voltage to the green and blue data lines at times T1 and T2, respectively, can overwrite visual artifacts that otherwise may have persisted until the next frame.

Figure 10B:
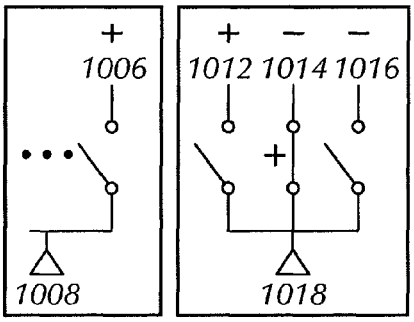

At time T1, a first application of voltage can be applied to green data line 1014 as illustrated in FIG. 10B. Demultiplexer 1018 can apply a positive target voltage to the green data line, changing its voltage from negative to positive. This large change in voltage can affect the voltage level on red data line 1012. As indicated above, the red data line has a positive voltage after time T0. The positive increase in voltage on the green data line can increase the magnitude of the voltage on the red data line, which can cause the red sub-pixel to brighten. As such, applying voltage to the green data line at time T1 can result in a brighter red sub-pixel. Although a visual artifact may also appear on blue data line 1016, this artifact may not persist as a subsequent application of voltage to the blue data line can occur at time T2.

Figure 10C:
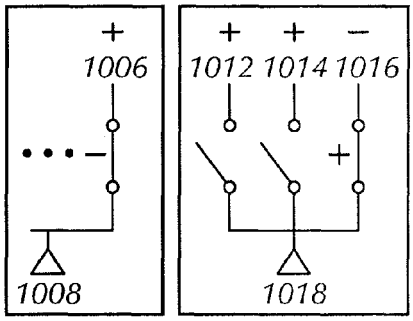

At time T2, a voltage can be applied to blue data line 1016 in pixel 1010 and blue data line 1006 in pixel 1000 as illustrated in FIG. 10C. With respect to blue data line 1016, demultiplexer 1018 can apply a positive target voltage changing the polarity on the blue data line from negative to positive. The change in voltage on the blue data line can affect the voltage levels on green data line 1014 and a red data line of an adjacent pixel (not shown). The effect on the red data line in the adjacent pixel will not be discussed. With respect to green data line 1014, the positive increase in voltage on the blue data line can increase the magnitude of the voltage on the green data line which can cause the green sub-pixel to brighten.

The application of voltage to blue data line 1006 at time T2 can also affect its neighboring red sub-pixel. As illustrated, demultiplexer 1008 can apply a negative target voltage to blue data line 1006, changing its polarity from positive to negative. This decrease in polarity can decrease the magnitude of the positive voltage on red data line 1012 which can cause the red sub-pixel to darken. However, as explained above, applying a voltage to green data line 1014 at time T1 caused the red sub-pixel to brighten. Because voltage is applied to these data lines quickly, the darkening of the red sub-pixel at time T2 can substantially correct the brightening of the red sub-pixel at time T1, which can render these artifacts undetectable.

Figure 10D:
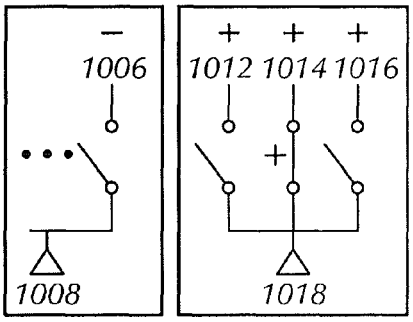

At time T3, demultiplexer 1018 can apply a positive target voltage to green data line 1014 as illustrated in FIG. 10D. Doing so can bring the voltage on the green data line up to the target voltage. Resetting the voltage on the green data line to this target value can also correct any darkening artifacts on the green sub-pixel that previously appeared when voltage was applied to blue data line 1016 at time T2.

In the example embodiment described above, voltage can be applied to the red data line once, to the green data line twice, and to the blue data line once. The additional application of voltage to the green data line can eliminate or reduce the appearance of any visual artifacts on the green sub-pixel.

Although the above embodiments are described using column inversion schemes, a person of ordinary skill in the art would recognize that other inversion schemes may be used.

The above embodiments can use additional applications of voltage to the data lines to eliminate or reduce the presence of visual artifacts. These additional applications of voltage, however, may increase the time it takes to update a line which can decrease the refresh rate of the display panel.

Figure 11:
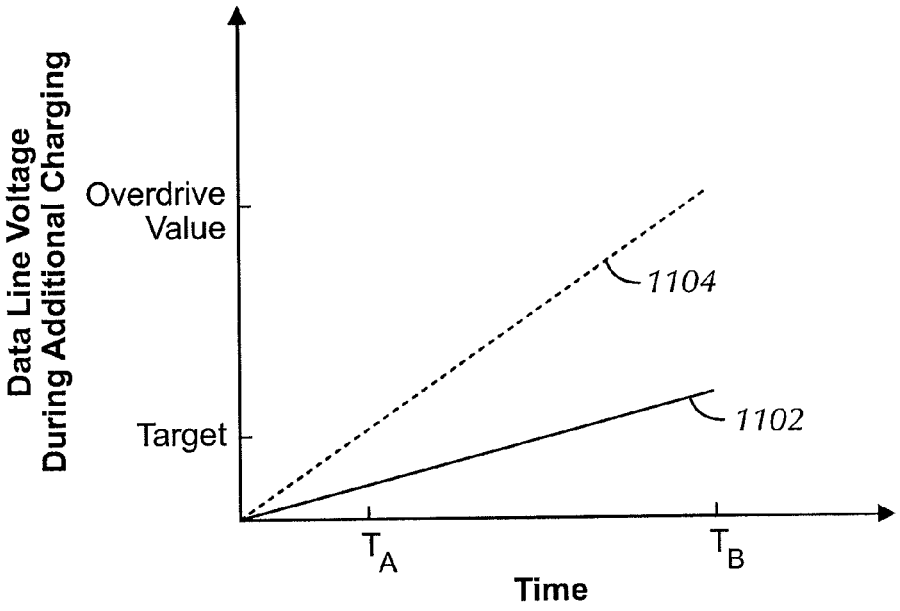
FIG. 11 illustrates an example of data line voltage overdriving according to embodiments of the disclosure.

In one embodiment, overdriving can be used to reduce the amount of time it takes to reach a desired target voltage value. Overdriving can be accomplished by applying a voltage that is greater than the target voltage in order to increase the voltage of the data line faster than merely applying the target voltage, and ceasing the application of voltage when the voltage of the data line reaches the target voltage value or a value close the target voltage. FIG. 11 illustrates the concept of overdriving. The illustrated graph has a horizontal axis representing time and a vertical axis representing the voltage on a data line. Curves 1102 and 1104 represent different methods of reaching the data line's target voltage.

Curve 1102 represents an application of the target voltage to a data line, which can cause the voltage on the data line can slowly increase to the desired target voltage. As illustrated, this process can take an amount of time $T_B$.

Curve 1104 represent an application of an overdrive voltage, which is higher than the target voltage, which can cause the voltage on the data line to reach the target voltage in a time $T_A$, which can be faster than the case of applying merely the target voltage. The overdrive value may, for example, be some multiple of the target voltage (e.g., five times the target voltage). Although the data line voltage can progress rapidly towards the overdrive value (solid line on curve 1104), the application of the overdrive voltage may be stopped once the target voltage is met at time $T_A$ (dashed line starting at time $T_A$ on curve 1104). By overdriving the data line along curve 1104, the data line may reach its target voltage more quickly than driving the data line along curve 1102. Although curves 1102 and 1104 are illustrated as linear functions, a person of ordinary skill in the art would recognize that the relationship between voltage and time can depend on the configuration of the system, and in some embodiments the relationship can be nonlinear, for example quadratic or cubic functions may better represent the driving of these data lines in other embodiments.

Some of the above embodiments can eliminate or reduce the presence of visual artifacts by providing additional applications of voltage to one or more data lines. However, as explained above, visual artifacts may not appear in every row of the display panel. Rather, the presence and location of these visual artifacts can depend on the inversion scheme used. For example, as described above with respect to reordered line inversion, the first row of each update set may have visual artifacts while other rows within the update set may not. The visual artifacts in the affected rows may be eliminated by providing additional applications of voltage. However, these additional applications of voltage may not be necessary in rows that lack visual artifacts. Accordingly, in some embodiments, a non-uniform line time may be used when additional applications of voltage are needed. This may be done by increasing the line time for the affected row or rows of sub-pixels by modifying the display panel's timing and control circuitry.

The above embodiments are described in terms of voltages with negative and positive polarities. However, a person of ordinary skill in the art would understand that this description can apply to other example embodiments wherein all voltages have the same polarity. In these example embodiments, the references to positive and negative polarities can, for example, refer to relatively higher or lower voltage values.

One or more of the functions of the above embodiments including, for example, the additional voltage applications and overdriving processes can be performed by computer-executable instructions, such as software/firmware, residing in a medium, such as a memory, that can be executed by a processor, as one skilled in the art would understand. The software/firmware can be stored and/or transported within any non-transitory computer-readable storage medium for use by or in connection with an instruction execution system, apparatus, or device, such as a computer-based system, processor-containing system, or other system that can fetch the instructions from the instruction execution system, apparatus, or device and execute the instructions. In the context of this document, a "non-transitory computer-readable storage medium" can be any physical medium that can contain or store the program for use by or in connection with the instruction execution system, apparatus, or device. The non-transitory computer-readable storage medium can include, but is not limited to, an electronic, magnetic, optical, electromagnetic, infrared, or semiconductor system, apparatus or device, a portable computer diskette (magnetic), a random access memory (RAM) (magnetic), a read-only memory (ROM) (magnetic), an erasable programmable read-only memory (EPROM) (magnetic), a portable optical disc such a CD, CD-R, CD-RW, DVD, DVD-R, or DVD-RW, or flash memory such as compact flash cards, secured digital cards, USB memory devices, memory sticks, and the like. In the context of this document, a "non-transitory computer-readable storage medium" does not include signals.

Figure 12:
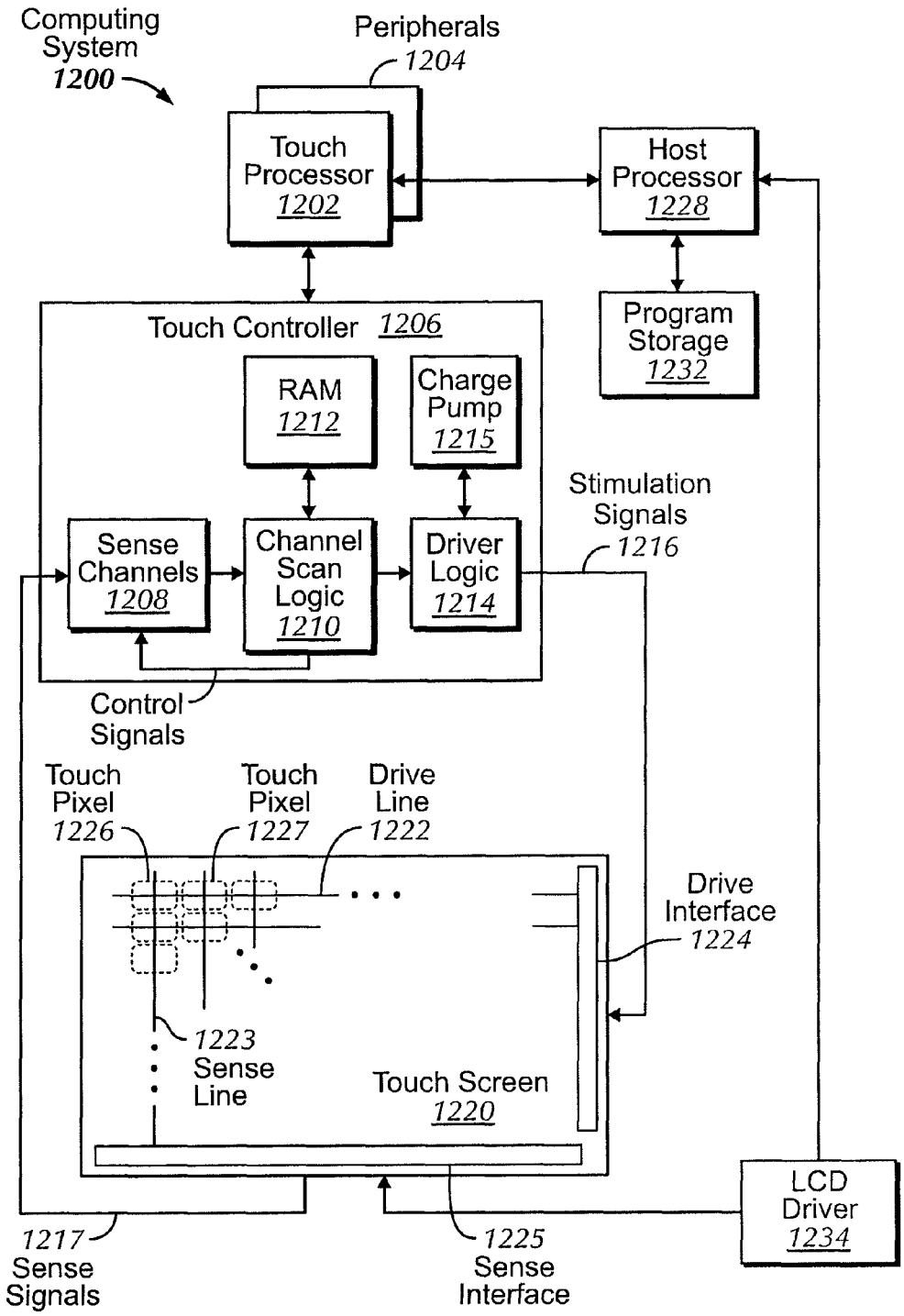
FIG. 12 is a block diagram of an example computing system that illustrates one implementation of an example display screen according to embodiments of the disclosure.

FIG. 12 is a block diagram of an example computing system 1200 that illustrates one implementation of an example display screen according to embodiments of the disclosure. In the example of FIG. 12, the computing system is a touch sensing system 1200 and the display screen is a touch screen 1220, although it should be understood that the touch sensing system is merely one example of a computing system, and that the touch screen is merely one example of a type of display screen. Computing system 1200 could be included in, for example, mobile telephone 136, digital media player 140, personal computer 144, or any mobile or non-mobile computing device that includes a touch screen. Computing system 1200 can include a touch sensing system including one or more touch processors 1202, peripherals 1204, a touch controller 1206, and touch sensing circuitry (described in more detail below). Peripherals 1204 can include, but are not limited to, random access memory (RAM) or other types of memory or non-transitory computer-readable storage media capable of storing program instructions executable by the touch processor 1202, watchdog timers and the like. Touch controller 1206 can include, but is not limited to, one or more sense channels 1208, channel scan logic 1210 and driver logic 1214. Channel scan logic 1210 can access RAM 1212, autonomously read data from the sense channels and provide control for the sense channels. In addition, channel scan logic 1210 can control driver logic 1214 to generate stimulation signals 1216 at various frequencies and phases that can be selectively applied to drive regions of the touch sensing circuitry of touch screen 1220. In some embodiments, touch controller 1206, touch processor 1202 and peripherals 1204 can be integrated into a single application specific integrated circuit (ASIC). A processor, such as touch processor 1202, executing instructions stored in non-transitory computer-readable storage media found in peripherals 1204 or RAM 1212, can control touch sensing and processing, for example.

Computing system 1200 can also include a host processor 1228 for receiving outputs from touch processor 1202 and performing actions based on the outputs. For example, host processor 1228 can be connected to program storage 1232 and a display controller, such as an LCD driver 1234. Host processor 1228 can use LCD driver 1234 to generate an image on touch screen 1220, such as an image of a user interface (UI), by executing instructions stored in non-transitory computer-readable storage media found in program storage 1232, for example, to control the demultiplexers, voltage levels and the timing of the application of voltages as described above to apply voltage to a data line more than once during a write sequence. Host processor 1228 can use touch processor 1202 and touch controller 1206 to detect a touch on or near touch screen 1220, such a touch input to the displayed UI. The touch input can be used by computer programs stored in program storage 1232 to perform actions that can include, but are not limited to, moving an object such as a cursor or pointer, scrolling or panning, adjusting control settings, opening a file or document, viewing a menu, making a selection, executing instructions, operating a peripheral device connected to the host device, answering a telephone call, placing a telephone call, terminating a telephone call, changing the volume or audio settings, storing information related to telephone communications such as addresses, frequently dialed numbers, received calls, missed calls, logging onto a computer or a computer network, permitting authorized individuals access to restricted areas of the computer or computer network, loading a user profile associated with a user's preferred arrangement of the computer desktop, permitting access to web content, launching a particular program, encrypting or decoding a message, and/or the like. Host processor 1228 can also perform additional functions that may not be related to touch processing.

Touch screen 1220 can include touch sensing circuitry that can include a capacitive sensing medium having a plurality of drive lines 1222 and a plurality of sense lines 1223. It should be noted that the term "lines" is sometimes used herein to mean simply conductive pathways, as one skilled in the art will readily understand, and is not limited to elements that are strictly linear, but includes pathways that change direction, and includes pathways of different size, shape, materials, etc. Drive lines 1222 can be driven by stimulation signals 1216 from driver logic 1214 through a drive interface 1224, and resulting sense signals 1217 generated in sense lines 1223 can be transmitted through a sense interface 1225 to sense channels 1208 (also referred to as an event detection and demodulation circuit) in touch controller 1206. In this way, drive lines and sense lines can be part of the touch sensing circuitry that can interact to form capacitive sensing nodes, which can be thought of as touch picture elements (touch pixels), such as touch pixels 1226 and 1227. This way of understanding can be particularly useful when touch screen 1220 is viewed as capturing an "image" of touch. In other words, after touch controller 1206 has determined whether a touch has been detected at each touch pixel in the touch screen, the pattern of touch pixels in the touch screen at which a touch occurred can be thought of as an "image" of touch (e.g. a pattern of fingers touching the touch screen).

In some example embodiments, touch screen 1220 can be an integrated touch screen in which touch sensing circuit elements of the touch sensing system can be integrated into the display pixels stackups of a display.

Although embodiments of this disclosure have been fully described with reference to the accompanying drawings, it is to be noted that various changes and modifications will become apparent to those skilled in the art. Such changes and modifications are to be understood as being included within the scope of embodiments of this disclosure as defined by the appended claims.

What is claimed is:

1. A method of scanning a display during a first update, the method comprising:

applying a first voltage to a first sub-pixel;

applying a second voltage to a second sub-pixel;

applying a third voltage to a third sub-pixel, the third sub-pixel being adjacent to the first sub-pixel and second sub-pixel, wherein a magnitude of the third voltage is a target voltage reached by overdriving the third sub-pixel to an overdrive voltage and stopping the overdriving when the magnitude of the third voltage is approximately equal to a magnitude of the target voltage for the third sub-pixel, a magnitude of the overdrive voltage being greater than the magnitude of the target voltage for the third sub-pixel;

applying a fourth voltage to the first sub-pixel after the application of the third voltage, the fourth voltage having a same polarity as the first voltage; and applying a fifth voltage to the second sub-pixel after the application of the third voltage, the fifth voltage having a same polarity as the second voltage.

2. The method of claim 1, wherein the fourth voltage is applied after the application of the fifth voltage.

3. The method of claim 1, wherein the third voltage is a target voltage for the third sub-pixel, the fourth voltage is a target voltage for the first sub-pixel, and the fifth voltage is a target voltage for the second sub-pixel.

4. The method of claim 1 further comprising:

applying a sixth voltage to the third sub-pixel after the application of the fourth voltage and the fifth voltage, the sixth voltage having an opposite polarity as the third voltage.

5. The method of claim 1, wherein the fifth voltage is applied after the application of the fourth voltage.

6. The method of claim 1, wherein the write sequence includes a first write sequence and a second write sequence, the first write sequence is a red-green-blue-green-red write sequence, and the second write sequence is a green-blue-red-green-blue write sequence.

7. The method of claim 1, wherein a magnitude of the first voltage includes one of zero volts, a mid-level gray voltage, a magnitude that is the same as a magnitude of the fourth voltage, and a magnitude that is greater than the magnitude of the fourth voltage.

8. The method of claim 1, the method further comprising performing the method of scanning for some of the rows but not all of the rows of the display panel.

9. A non-transitory computer-readable storage medium storing computer-readable program instructions executable to perform a method for scanning a display during a first update, the method comprising:

applying a first voltage to a first sub-pixel;

applying a second voltage to a second sub-pixel;

applying a third voltage to a third sub-pixel, the third sub-pixel being adjacent to the first sub-pixel and the second sub-pixel, wherein a magnitude of the third voltage is a target voltage reached by overdriving the third sub-pixel to an overdrive voltage and stopping the overdriving when the magnitude of the third voltage is approximately equal to a magnitude of the target voltage for the third sub-pixel, the magnitude of the overdrive voltage being greater than the magnitude of the target voltage for the third sub-pixel;

applying a fourth voltage to the first sub-pixel after the application of the third voltage, the fourth voltage having a same polarity as the first voltage; and applying a fifth voltage to the second sub-pixel after the application of the fourth voltage, the fifth voltage having a same polarity as the second voltage.

10. The non-transitory computer-readable storage medium of claim 9, wherein the fourth voltage is applied after the application of the fifth voltage.

11. The non-transitory computer-readable storage medium of claim 9, wherein the third voltage is a target voltage for the third sub-pixel, the fourth voltage is a target voltage for the first sub-pixel, and the fifth voltage is a target voltage for the second sub-pixel.

12. The non-transitory computer-readable storage medium of claim 9, the method further comprising:

applying a sixth voltage to the third sub-pixel after the application of the fourth voltage and the fifth voltage, the sixth voltage having an opposite polarity as the third voltage.

13. The non-transitory computer-readable storage medium of claim 9, wherein a magnitude of the first voltage includes one of zero volts, a mid-level gray voltage, a magnitude that is the same as a magnitude of the fourth voltage, and a magnitude that is greater than the magnitude of the fourth voltage.

14. The non-transitory computer-readable storage medium of claim 9, the method further comprising performing the method of scanning for some of the rows but not all of the rows of the display panel.

15. A display apparatus comprising:

an array of display sub-pixels, each display sub-pixel associated with one of a plurality of scan lines and one of a plurality of data lines, a common electrode, and an individually addressable pixel electrode, the common electrode being electrically connected to a voltage source; and a module connected to the array of pixels, the module configured to electrically connect the plurality of data lines to the array of display sub-pixels and during a first update, apply a first voltage to a first data line coupled to a first display sub-pixel, apply a second voltage a second data line coupled to a second display sub-pixel, apply a third voltage to a third data line coupled to a third display sub-pixel, the third sub-pixel being adjacent to the first sub-pixel and the second sub-pixel, wherein a magnitude of the third voltage is a target voltage reached by overdriving the third data line to an overdrive voltage and stopping the overdriving when the magnitude of the third voltage is approximately equal to a magnitude of the target voltage for the third data line, a magnitude of the overdrive voltage being greater than the magnitude of the target voltage for the third data line, apply a fourth voltage to the first data line coupled to the first display sub-pixel after the application of the third voltage, the fourth voltage having a same polarity as the first voltage, and apply a fifth voltage to the second data line coupled to the second display sub-pixel after the application of the third voltage, the fifth voltage having a same polarity as the second voltage.

16. The display apparatus of claim 15, wherein the fourth voltage is applied after the application of the fifth voltage.

17. The display apparatus of claim 15, wherein the third voltage is a target voltage for the third data line, the fourth voltage is a target voltage for the first data line, and the fifth voltage is a target voltage for the second data line.

18. The display apparatus of claim 15, the module further configured to apply a sixth voltage to the third data line after the application of the fourth voltage, the sixth voltage having an opposite polarity as the third voltage.

19. The display apparatus of claim 15, wherein a magnitude of the first voltage includes one of zero volts, a mid-level gray voltage, a magnitude that is the same as the magnitude of the fourth voltage, and a magnitude that is greater than the magnitude of the fourth voltage.

20. The display apparatus of claim 15, the module further configured to perform the method of scanning for some of the rows but not all of the rows of the display panel.

21. The display apparatus of claim 15, wherein the module is disposed within a liquid crystal display driver module.

22. The display apparatus of claim 15, wherein the module is disposed within a host video driver.

* * * * *